US006927766B2

(12) United States Patent
Tagawa et al.

(10) Patent No.: US 6,927,766 B2
(45) Date of Patent: Aug. 9, 2005

(54) IMAGE DISPLAY APPARATUS

(75) Inventors: Akira Tagawa, Kashiwa (JP); Masaaki Kabe, Atsugi (JP)

(73) Assignee: Sharp Kabushiki Kaisha, Osaka (JP)

( * ) Notice: Subject to any disclaimer, the term of this patent is extended or adjusted under 35 U.S.C. 154(b) by 252 days.

(21) Appl. No.: 09/923,627

(22) Filed: Aug. 7, 2001

(65) Prior Publication Data

US 2002/0044116 A1 Apr. 18, 2002

(30) Foreign Application Priority Data

Aug. 8, 2000 (JP) ..... 2000-240500

(51) Int. Cl.[7] ..... G09G 5/00
(52) U.S. Cl. ..... 345/204; 345/100; 345/102
(58) Field of Search ..... 345/84, 87, 90, 345/92, 98–100, 102, 104, 204, 206, 207, 214, 91

(56) References Cited

U.S. PATENT DOCUMENTS

| | | | | |
|---|---|---|---|---|
| 3,654,606 A | | 4/1972 | Marlowe et al. | 345/87 |
| 3,811,751 A | * | 5/1974 | Myer | 349/69 |
| 5,151,803 A | | 9/1992 | Wakita et al. | 359/97 |
| 5,402,143 A | * | 3/1995 | Ge et al. | 345/102 |
| 5,670,973 A | | 9/1997 | Bassetti, Jr. et al. | 345/58 |
| 5,712,652 A | * | 1/1998 | Sato et al. | 345/90 |
| 6,115,016 A | * | 9/2000 | Yoshihara et al. | 345/88 |
| 6,317,181 B1 | * | 11/2001 | Hoshino | 349/98 |
| 6,400,432 B2 | * | 6/2002 | Kuroiwa et al. | 349/96 |
| 6,509,887 B1 | * | 1/2003 | Kondoh et al. | 345/87 |

FOREIGN PATENT DOCUMENTS

| | | | | |
|---|---|---|---|---|
| JP | 62-156623 | | 7/1987 | |
| JP | 04-058708 | * | 3/1992 | G09G/3/36 |
| JP | 5-265403 | | 10/1993 | |
| JP | 5-303076 | | 11/1993 | |
| JP | 11-084343 | | 3/1999 | |
| JP | 11-237606 | | 8/1999 | |

* cited by examiner

*Primary Examiner*—Bipin Shalwala
*Assistant Examiner*—Mansour M. Said
(74) *Attorney, Agent, or Firm*—Edwards & Angell, LLP; David G. Conlin; George W. Hartnell, III

(57) ABSTRACT

An image display apparatus comprises a display section including picture elements for modulating light transmission or reflection, a driving section for performing an addressing scan of the picture elements in such a manner as to successively change light modulation states of the picture elements in each display frame, and a light emitting section for illuminating the display section. The light emitting section is switched ON-OFF once in each display frame, the addressing scan for the picture elements is performed in the OFF state of the light emitting section in each display frame, and the sequence of the addressing scan is reversed every one or more display frames.

20 Claims, 10 Drawing Sheets

1ST FRAME
2ND FRAME
SCANNING LINE
1
n
ADDRESSING SCAN
ADDRESSING SCAN
t1
tn
tb1
TIME

BACKLIGHT
LIGHTING
LIGHTING
TIME

OPTICAL RESPONSE IN P1x
τ 1
τ n
TIME

OPTICAL RESPONSE IN Pnx
τ n
τ 1
TIME

SCANNING LINE
1ST FRAME
2ND FRAME
1
n
ADDRESSING SCAN
ADDRESSING SCAN
t1
tn
tbl
TIME

BACKLIGHT
LIGHTING
LIGHTING
TIME

OPTICAL RESPONSE IN P1x
V
V
TIME

OPTICAL RESPONSE IN Pnx
TIME

IMAGE DISPLAY APPARATUS

BACKGROUND OF THE INVENTION

1. Field of the Invention

The present invention relates to an image display apparatus which provides a uniform brightness distribution on a display panel when an addressing scan is performed for the display panel.

2. Description of the Related Art

A liquid crystal display apparatus including a combination of thin-film transistors (TFT) and nematic liquid crystal has been commercialized as a 20-inch liquid crystal television or the like. However, some improvements in image quality are required for liquid crystal display apparatuses to replace a currently dominant display apparatus, i.e., a cathode-ray tube (CRT) apparatus, in the future. Liquid crystal apparatuses are hereinafter also referred to as an "LCD". Cathode-ray tube apparatuses are hereinafter also referred to as a "CRT".

The biggest disadvantage of liquid crystal display apparatuses is a lesser display performance for moving images as compared to a CRT. At present, a commercially available liquid crystal display apparatus can provide image quality as good as that of a CRT in terms of still images, moving images having relatively slow motion, and the like. For moving images having fast motion, such as a TV sport program, there is a large disparity in display between liquid crystal display apparatuses and CRTs. When displaying moving images having fast motion, it takes a long time for the brightness of an image to be uniform in liquid crystal display apparatuses. This causes the image to appear blurred, resulting in an unclear image.

Recently, blurred images of liquid crystal display apparatuses have been vigorously studied. It is believed that the blurred image generated on liquid crystal display apparatuses is attributed only to the slow time response speed of liquid crystal elements with respect to displaying light. Nematic liquid crystal, which is often used in current TN (twisted-nematic) mode liquid crystal display apparatuses, has a time response speed with respect to displaying light which is slower than one display frame (typically, 1/60 seconds). Therefore, since the time response of the liquid crystal itself is longer than one frame period, a blur appears in a displayed image. When using pi-cell mode liquid crystal which has a time response speed with respect to displaying light shorter than one frame period, a blurred image is suppressed but is not completely eliminated (e.g., see "New LCD with pi-cell supporting moving images", Nakamura et al., p. 99, Vol.3, EKISHO). As is seen from the above, a blurred image of the liquid crystal display apparatuses cannot be avoided only by improving the time response speed of liquid crystal with respect to displaying light. In the case of present TFT-nematic mode liquid crystal display apparatuses, a blurred image is perceived in moving images. Therefore, it is important to eliminate a blurred image.

Further, i t has been reported that a blurred image of liquid crystal display apparatuses is largely attributed to a difference in a displaying method between CRTs and LCDs (see "Displaying Method and Image Quality of Moving Image Display in Hold-type Display", Kurita, p. 1, 1998, Japan Liquid Crystal Society, Proceedings of First LCD Forum "An effort for causing LCD to make inroads into CRT monitor market—from the viewpoint of moving image display"). A difference in a displaying method between LCDs and CRTs, and its influence on moving image quality will be described below. CRTs and LCDs have different response times with respect to displaying light.

FIGS. 4A and 4B show time response characteristics of CRTs and LCDs with respect to displaying light. FIG. 4A shows that the brightness of a CRT with respect to displaying light rises steeply with respect to time (i.e., an impulse type). FIG. 4B shows that the brightness of an LCD with respect to displaying light is widely distributed (i.e., a hold type). The time response characteristics of the brightness of LCDs are attributed to the following factors. Liquid crystal itself does not emit light, but functions as a shutter which transmits or blocks a backlight beam. Further, the time response speed of liquid crystal with respect to displaying light is slow, e.g., the time response speed of twisted nematic (TN) liquid crystal with respect to displaying light is about 15 ms, so that the time response speed is almost equal to one field time of 16.7 ms. It should be noted that response speed and response time have the same meaning in this specification.

As described above, an LCD is a display apparatus of a hold type. If tracking movements (the movements of left and right eyes in which both eyes track a moving object smoothly and similarly) which are the most important of the eye movements for perception of moving images, and the time integral effect of a visual system are substantially ideal, a viewer only perceives an average brightness of several picture elements. Therefore, the viewer cannot perceive the content of individual images represented by picture elements of the display. The proportion of the tracking movements for perceiving moving images to the eye movements is decreased with an increase in the speed of the moving images. The motion of a moving image having an angular velocity within 4 to 5 degrees/second can be tracked only by the tracking movements. The tracking movement for motion having a short duration is considered to have a maximum speed of 30 degrees/second. Regarding the time integral effect of a visual system, it is believed that a light stimulus having a short duration of several tens of milliseconds can be thoroughly integrated if the brightness of the light stimulus is less than or equal to a predetermined value. Actually, most moving images displayed on an LCD satisfy the above-described conditions of angular velocity and brightness, so that a blur appears in such moving images in the case of the hold type display. Such a phenomenon occurs in not only an LCD but also most display apparatuses, including an optical modulator for modulating a backlight beam.

In order to eliminate a blur image thoroughly, liquid crystal display apparatuses need to have the time response of brightness of an impulse type just as in a CRT (see FIG. 4A). To this end, a backlight does not always stay ON, but emits light in a pulse-like manner. Such an apparent impulse-type display would be realized by transmitting or blocking a backlight beam alternately using a shutter, or by flashing a backlight beam at high frequency, for example. In either case, however, the response time of the brightness of liquid crystal with respect to displaying light is longer than the duration of one light impulse, resulting in a deterioration in display quality.

FIG. 5A is a graph showing a change in the transmission of liquid crystal (LCD) over time. FIG. 5B is a graph showing the period of the ON-state (light emission) of a backlight. In FIG. 5A, "t" refers to the time required to open one gate line which is a scanning line for a TFT (gate ON time), and "n" refers to the number of scanning lines (gate lines). If a display apparatus has n scanning lines, it takes t×n to switch ON all TFTs. In FIG. 5A, solid curves (first line and $n^{th}$ line) represent a change in the transmission (time response characteristics). "τr" refers to an intervening period from the end of a drive operation to the switch-ON of a backlight. As shown in FIG. 5B, after the last nth scanning line is switched ON and the liquid crystal corresponding to the $n^{th}$ scanning line responds, the backlight is switched ON or emits light, thereby making it possible to achieve impulse type display similar to CRT.

The ratio of an emission period of a backlight to one frame period (compaction ratio), which effectively achieves impulse type display, is preferably 25% with respect to one frame of 16.7 ms. (see "Displaying Method and Image Quality of Moving Image Display in Hold-type Display", Kurita, p. 1, 1998, Japan Liquid Crystal Society, Proceedings of First LCD Forum "An effort for causing LCD to make inroads into CRT monitor market—from the viewpoint of moving image display"). A reduction in the compaction ratio leads to a decrease in brightness. Therefore, the compaction ratio of about 50% or less is typically practical. The emission period of a backlight is about 8 ms when the compaction ratio is about 50%, and is about 4 ms when the compaction ratio is about 25%.

FIGS. 6A and 6B are time charts of addressing scan of scanning lines and the emission period of a backlight when the compaction ratio is about 50%, respectively. In FIG. 6A, one display frame period is 16.7 ms. An intervening period (τr) of 1.2 ms is provided between the end of an addressing scan period (Td) from the first scanning line to the $n^{th}$ scanning line and the switching-ON of a backlight. The emission period (Tbl) of the backlight is 8.3 ms since the compaction ratio is 50%. Since the response speed of liquid crystal with respect to displaying light is currently about 15 ms, the intervening period (τr) is preferably longer. However, one display frame period is typically defined to be 16.7 ms. A longer intervening period (τr) leads to a decrease in a time which can be allocated for an addressing scan of a scanning line.

The time (Td) required for an addressing scan of a scanning line is determined by the number of scanning lines in a display apparatus. The gate ON time "t" of current TFT-LCDs is about 10 μs in the case of amorphous silicon (α-Si)-TFTs which achieve a large-sized display apparatus (20-inch), and about 3 μs in the case of polysilicon (p-Si) -TFTs which are not suitable for a large-sized display apparatus but have high electron mobility. A time required for an addressing scan of scanning lines contained in an entire screen is about n×10 μs in the case of an (αSi)-TFT-LCD, and about n×3 μs in the case of polysilicon a (p-Si)-TFT-LCD, where n is the number of scanning lines.

When a progressive scan high-definition television broadcast having 720 scanning lines is reproduced, for example, the time required for an addressing scan of scanning lines contained in an entire screen is about 7.2 ms in the case of an (α-Si)-TFT type LCD, and about 2.2 ms in the case of a (p-Si)-TFT type LCD. As shown in FIG. 6B, if the compaction ratio of a backlight is assumed to be 50% (the emission period of a backlight is 8.3 ms), the intervening period (τr) is about 1.2 ms in the case of the (α-Si)-TFT type LCD, and about 6.2 ms in the case of the (p-Si)-TFT type LCD. The rise response time of conventionally well known TN liquid crystal with respect to displaying light is about 15 ms as described above, such that the response of the TN liquid crystal also is not completed within the intervening period (τr) when the backlight system is modified to be of an impulse type.

Since the response speed of a display element with respect to displaying light is longer than the intervening period (τr), display deviation occurs in an actual display apparatus. In FIG. 6A, the intervening period (τr) is about 1.2 ms. Actually, picture elements on the first scanning line 1 are driven at time t1 while picture elements on the $n^{th}$ scanning line n are driven at time tn. Therefore, a time from when picture elements are driven to when a backlight is switched ON, is Td+τr for the picture elements on the scanning line 1 and τr for the picture elements on the scanning line n. If the response speed of a display element with respect to displaying light is much smaller than the intervening period (τr), the difference Td+τr and τr does not cause a problem. As described above however, the response speed of liquid crystal with respect to displaying light is longer than the intervening period (τr) in actual liquid crystal display apparatuses, so that the transmission of the picture elements on the scanning line 1 is different from the transmission of the picture elements on the scanning line n. This leads to a difference in appearance between these picture elements.

FIG. 7A is a time chart showing an addressing scan of picture elements on scanning lines. FIG. 7B is a time chart showing the switching ON-OFF of a backlight. FIG. 7C is a time chart showing the optical response of a picture element P1*x* on the scanning line 1. FIG. 7D is a time chart showing the optical response of a picture element Pnx on the scanning line n. Both the picture element P1*x* and the picture element Pnx perform black display in a previous frame before a current frame. In two subsequent frames (first and second frames), driving voltages are applied to the picture element P1*x* and the picture element Pnx in such a manner as to provide the same gray level (ideally, the brightness of the picture element P1*x* is equal to the brightness of the picture element Pnx when the same driving voltage is applied).

As shown in FIGS. 7A and 7B, the addressing scan of picture elements is successively carried out from the first scanning line 1 to the last scanning line n in the first and second frames as well as the other display frames. The ON-OFF timing of a backlight is as follows. In each display frame, the backlight is OFF in a period of time during which the picture elements are addressing-scanned. After the addressing scan of the picture elements and the subsequent intervening period, the backlight is ON until the end of the display frame. This ON-OFF timing of the backlight is repeated for each display frame.

As shown in FIGS. 7C and 7D, a driving voltage is applied to the picture element P1*x* belonging to the first scanning line 1 at time t1 of the first frame, while a driving voltage is applied to the picture element Pnx belonging to the last scanning line n at time tn of the first frame. The backlight is OFF in the addressing scan period of the first frame (from t1 to tn) and the intervening period (from tn to tbl). At time tbl, the backlight is switched ON. Therefore, hatched portions of the first frame in FIGS. 7C and 7D are recognized as the brightness of the picture elements P1*x* and Pnx by the eyes of a human being, respectively.

As is apparent from FIGS. 7C and 7D, although driving voltages to provide the same gray level are applied to the respective picture elements P1*x* and Pnx, the brightness of the picture element Pnx is much smaller than the brightness of the picture element P1*x*. From this reason, although an attempt is made to provide the same gray level, display deviation occurs between the picture element P1*x* belonging to the first scanning line 1 and the picture element Pnx belonging to the last scanning line n. As described above, this is because the response speed of liquid crystal with respect to displaying light is longer than the intervening period (τr). In the subsequent second frame, as shown in FIGS. 7C and 7D, the relationship between the magnitudes of brightness of the picture element P1*x* belonging to the first scanning line 1 and the picture element Pnx belonging to the last scanning line n is the same as described above. That is, the brightness of the picture element Pnx is smaller than the brightness of the picture element P1*x* (see hatched portions of the second frame). This situation shows that the deviation of the brightness of picture elements occurs in a plurality of display frames.

Therefore, in order to eliminate such a display deviation, an effort has been made to increase the response speed of liquid crystal with respect to displaying light.

FIG. 8 shows the field response property of nematic liquid crystal provided between glass substrates 1 and 2 arranged in parallel. Transparent ITO (Indium Tin Oxide) electrodes are provided on the respective opposed sides of the glass substrates 1 and 2. The illustrated columns between the glass substrates 1 and 2 represent a liquid crystal molecule 3. The lengthwise direction of the liquid crystal molecule 3 is parallel to the glass substrates 1 and 2. Nematic liquid crystal performs switching due to dielectric anisotropy $\Delta\in$ which is the difference between the dielectric constant ($\in$p) parallel to the long molecular axis and the dielectric constant ($\in$v) parallel to the short molecular axis. When an electric field 4 of E (N/C) is applied perpendicularly across the glass substrates 1 and 2, interaction with the dielectric anisotropy $\Delta\in$ generates a dielectric energy of $(1/2)\Delta\in E^2$, resulting in a torque which changes the orientation of the molecule. In the case of nematic liquid crystal, when $\Delta\in$ is positive, the orientation of the molecule is changed in such a manner as to cause the the long molecular axis to be parallel to the electric field 4, while when $\Delta\in$is negative, the orientation of the molecule is changed in such a manner as to cause the long molecular axis to be perpendicular to the electric field 4. The dielectric energy of $(1/2)\Delta\in E^2$ is a scalar quantity which does not depend on the direction of the electric field 4. Therefore, even if the electric field 4 is generated by alternating current, the orientation of the nematic liquid crystal is changed in one direction. When the nematic liquid crystal is deprived of the electric field 4, the nematic liquid crystal returns to an initial orientation state due to viscous relaxation. In this case, an optical fall time ($\tau$d) at the time of the removal of the electric field 4 is longer than an optical rise time ($\tau$r) at the time of the application of the electric field 4.

FIG. 9 shows the field response property of ferroelectric liquid crystal provided between parallel glass substrates 1 and 2. Transparent ITO electrodes are provided on the opposed faces of the glass substrates 1 and 2. The illustrated columns between the glass substrates 1 and 2 represent a liquid crystal molecule 3. The long molecular axis of the liquid crystal molecule 3 is parallel to the glass substrates 1 and 2. The ferroelectric liquid crystal exhibits spontaneous polarization 5 generated perpendicularly to the long molecular axis of the liquid crystal molecule 3. The ferroelectric liquid crystal performs switching due to the inner product energy Ps·E of the spontaneous polarization 5 and the electric field 4 applied perpendicularly across the glass substrates 1 and 2 where Ps ($C/m^2$) represents the spontaneous polarization 5 and E represents the electric field 4. Since the orientation of the spontaneous polarization 5 is parallel to the direction of the electric field 4, the switching is performed while the molecule remains parallel to the substrates 1 and 2. This switching is called inplane switching. The inner product energy Ps·E of the spontaneous polarization 5 and the electric field 4 is a vector quantity which depends on the direction of the electric field 4. Therefore, the optical rise time ($\tau$r) and the optical fall time ($\tau$d) can be switched at high speed by the directions of the electric field 4.

Although ferroelectric liquid crystal is significantly advantageous in terms of optical response speed, ferroelectric liquid crystal has a number of specific problems which do not arise in nematic liquid crystal. Ferroelectric liquid crystal is a smectic liquid crystal, which is close to a crystal compared to nematic liquid crystal so that a molecule array has a layer structure. Therefore, it is difficult to obtain uniform alignment over a large area for ferroelectric liquid crystal. In addition, the layer structure of ferroelectric liquid crystal is readily disturbed by a mechanical shock, resulting in nonuniform alignment. Therefore, ferroelectric liquid crystal has less reliability. To avoid such a drawback, a wall-like structure is provided within a display apparatus using ferroelectric liquid crystal so as to firmly attach substrates to each other, thereby obtaining shock resistance (see "17" Video-Rate Full Color FLCD", N. Itoh et al., Proc. of The Fifth International Display Workshops, p. 205 (1998)). In this case however, the formation of walls makes it further difficult to obtain alignment. Further, since ferroelectric liquid crystal exhibits spontaneous polarization, liquid crystal is left oriented in one direction unless switching is triggered by the input of a display signal. If this situation is maintained for a long time, electric charge is accumulated at an interface between the ferroelectric liquid crystal and an alignment film, resulting in "burn-in", for example.

Further, ferroelectric liquid crystal needs to have a structure having a thin cell thickness of 1.5 $\mu$m to 2.0 $\mu$m in order to sufficiently exploit the properties of the ferroelectric liquid crystal. In the case of typical nematic liquid crystal, the cell thickness is about 4.0 $\mu$m. Therefore, the capacitance of the ferroelectric liquid crystal cell is larger than that of the typical nematic liquid crystal cell. The amount of electric charge to a picture element via a TFT in a predetermined time is reduced, so that switching is likely to be insufficient. To avoid this problem, the charging capability of a TFT may be enhanced, but this requires for the structure of the TFT to be largely modified, leading to an increase in difficulty in manufacturing which is undesirable in terms of cost.

From that reason, attempts have been vigorously made to improve the optical response speed of nematic liquid crystal which is conventionally used. In an actual study, alignment states other than well-known TN alignment which is currently dominant are used to enhance the optical response speed. For example, an alignment state, such as bend-cell and pi-cell, is used to increase the response of nematic liquid crystal (see "Wide viewing angle display mode for active matrix LCD using bend alignment liquid crystal cell", T. Miyashita et al., Conference Proceedings of The 13$^{th}$ International Display Research Conference (EuroDisplay '93), p. 149 (1993)).

It has been reported that with a bend alignment cell, the optical rise response time of a TN alignment cell which had been conventionally about 15 ms could be reduced to about 2 ms. This improvement in response time is achieved by controlling the flow of liquid crystal generated within the cell by the response of the liquid crystal (see Miyashita et al., "Field Sequential Full Color Liquid Crystal Display using Fast Response of OCB Liquid Crystal" in Proceedings of First LCD Forum "An effort for causing LCD to make inroads into CRT monitor market—from the viewpoint of moving image display", Japan Liquid Crystal Society, p. 7, 1998). The liquid crystal flow is considerably large in a twisted alignment state, such as TN alignment, leading to a reduction in the optical response speed of the liquid crystal. Only by performing switching between non-twisted vertical alignment and horizontal alignment, the optical rise response speed can be potentially improved just as with the bend-cell. Even in these types of liquid crystal where the flow of liquid crystal is lowered, dielectric anisotropy is utilized just as with typical nematic liquid crystal, so that the optical rise response speed is excellently fast at the time of the application of an electric field, but the optical fall response speed at the time of the removal of an electric field is slow.

As described above, it is difficult to satisfactorily improve the response speed of nematic liquid crystal using alignments currently reported other than the conventional TN alignment in terms of both the optical rise response time and the optical fall response time. Ferroelectric liquid crystal exhibits excellent fast response time, but presents a number of specific problems.

Further, the entire display panel is not necessarily illuminated at once by a backlight. Alternatively, as shown in FIG. 10B, the scanning lines from 1 through n may be evenly divided into blocks. A backlight may be provided for each block so that switching ON-OFF of the backlight can be separately performed for scanning lines in each block. In this case, even when address scanning is successively performed from picture elements belonging to the first scanning line 1 to picture elements belonging to the last scanning line n in the first display frame, the second display frame, and other display frames as shown in FIG. 10A, the intervening period from the end of the addressing scan to the switching ON of a backlight can be elongated for picture elements in the vicinity of the last scanning line n. Thereby, it is possible to reduce the difference in brightness between picture elements in the vicinity of the first scanning line 1 and picture elements in the vicinity of the last scanning line n. However, since a plurality of backlights are divided into blocks and the backlights are successively scanned and switched ON-OFF, an additional driving circuit for switching ON-OFF the backlights is required. Moreover, it is difficult to perfectly prevent light from leaking to adjacent blocks. Therefore, this method is not currently practical.

As described above, there has been reported a number of studies for improving images of liquid crystal display apparatuses. For example, Japanese Laid-Open Publication No. 62-156623 discloses an active matrix type liquid crystal display apparatus in which variations in applied voltage to liquid crystal are corrected by changing the scanning direction of a scanning line every predetermined interval.

Japanese Laid-Open Publication No. 5-265403 discloses a color sequential method in which an entire screen is erased when the colors of a color source are switched (e.g., the light source emits a red color, a green color, and a blue color in a time-division manner), and the scanning directions are switched every frame.

Japanese Laid-Open Publication No. 5-303076 discloses that the directions of address scanning are reversed every predetermined interval in order to prevent a "flicker due to a semiselective state" specific to ferroelectric liquid crystal.

Japanese Laid-Open Publication No. 11-84343 discloses a light scanning type spatial light modulator (SLM) in which address scanning is performed using light, and the scanning direction is reversed every one or a plurality of frames.

Japanese Laid-Open Publication No. 11-237606 discloses a liquid crystal display apparatus in which a light source is ON while address scanning is performed, and scanning lines in a first field are reset after having been successively scanned, and scanning lines in a subsequent second field are reset after having been successively scanned in the reverse sequence with respect to the scanning sequence of the first field.

However, in the above-described methods or apparatuses, an attempt to eliminate a blurred image by switching ON-OFF a light source, such as a backlight, is not made.

Moreover, in an image display apparatus having a feature for overcoming a blurred image by switching ON-OFF a backlight, when the response speed of a display element with respect to displaying light is not sufficiently fast, display deviation occurs. This is attributed to a period of time from when a driving voltage is applied to each picture element to be in a light modulation state (i.e., an addressing scan) to when a backlight is switched ON, is different among picture elements, and such a period is fixed for each picture element.

SUMMARY OF THE INVENTION

According to one aspect of the present invention, an image display apparatus comprises a display section including picture elements for modulating light transmission or reflection, a driving section for performing an addressing scan of the picture elements in such a manner as to successively change light modulation states of the picture elements in each display frame, and a light emitting section for illuminating the display section. The light emitting section is switched ON-OFF once in each display frame, the addressing scan for the picture elements is performed in the OFF state of the light emitting section in each display frame, and the sequence of the addressing scan is reversed every one or more display frames.

In one embodiment of the present invention, the sequence of the addressing scan of the picture elements is reversed every display frame.

In one embodiment of the present invention, the addressing scan of the picture elements is performed on every picture element on a scanning line.

In one embodiment of the present invention, each display frame includes successive first and second periods. In the first period, the addressing scan for changing the light modulation states of the picture elements is performed and the light emitting section is an OFF state. In the second period, the addressing scan is not performed and the light emitting section is in an ON state.

In one embodiment of the present invention, a frame period of each display frame is about 1/60 seconds In one embodiment of the present invention, in each display frame, an ON-state period of the light emitting section is less than or equal to about 50% of a frame period.

In one embodiment of the present invention, the light modulation states of all of the picture elements are reset before the start of the addressing scan of the picture elements in the display section.

In one embodiment of the present invention, the light modulation states of all of the picture elements are reset during the first period of each display frame.

In one embodiment of the present invention, each picture element includes a liquid crystal element.

In one embodiment of the present invention, the light modulation state of each picture element is controlled by an active element.

In one embodiment of the present invention, the light emitting section is a cold cathode tube.

In one embodiment of the present invention, the light emitting section is an electroluminescent element.

In one embodiment of the present invention, the light emitting section is a light emitting diode.

Thus, the invention described herein makes possible the advantages of providing an image display apparatus in which display deviation on a screen due to insufficient response speed with respect to displaying light substantially does not occur.

These and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described by way of illustrative examples with reference to the accompanying drawings.

In order to suppress display deviation on a screen, a period of time from when addressing scan is applied to each picture element in a display panel to when a backlight is switched ON is changed for each frame, so that the time period is substantially averaged in the display panel. To this end, the addressing scan sequence of picture elements may be alternately reversed between two successive display frames so that picture elements in the display panel have substantially the same light modulation state.

Figures 1A, 1B, 1C, 1D:
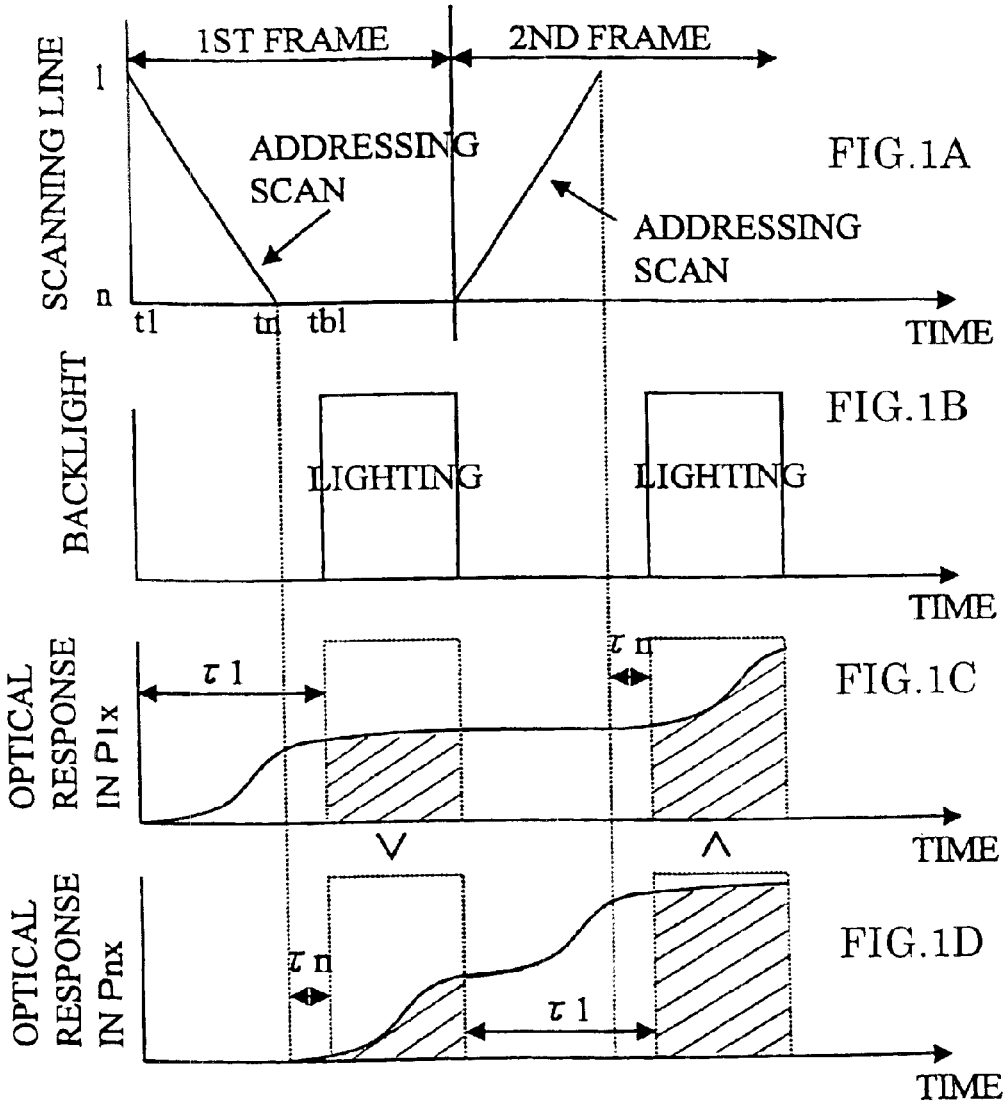
FIG. 1A is a time chart showing the address scanning for picture elements in an image display apparatus according to the present invention.
FIG. 1B is a time chart showing the switching ON-OFF of a backlight in the image display apparatus according to the present invention.
FIG. 1C is a time chart showing the optical response of a picture element P1*x* on a scanning line in the image display apparatus according to the present invention.
FIG. 1D is a time chart showing the optical response of a picture element Pnx on a scanning line in the image display apparatus according to the present invention.

FIGS. 1A through 1D are time charts for explaining a driving sequence of picture elements in an image display apparatus according to the present invention. FIG. 1A is a time chart showing address scanning of picture elements on scanning lines in first and second frames. FIG. 1B is a time chart showing the switching ON-OFF of a backlight. FIG. 1C is a time chart showing the optical response of a picture element P1*x* on the first scanning line 1. FIG. 1D is a time chart showing the optical response of a picture element Pnx on the last scanning line n.

As shown in FIG. 1B, the ON-OFF timing of a backlight is as follows. In each of first, second, and other display frames, the backlight is OFF in a period of time during which driving voltages are applied to picture elements on scanning lines (addressing scan period from t1 to tn). After the addressing scan period and a subsequent intervening period (from tn to tbl), the backlight is ON until the end of the display frame. This ON-OFF timing of the backlight is repeated for each display frame.

Referring to FIG. 1A, the addressing scan sequence of picture elements is alternately reversed between the successive first and second display frames so that picture elements on the first scanning line 1 through the last scanning line n have substantially the same light modulation state. Specifically, in the first frame, driving voltages are successively applied to the scanning lines 1, 2, 3, . . . , (n−1), and n in this order, while picture elements on each scanning line are address-scanned. In the second frame, driving voltages are successively applied to the scanning lines n, (n−1), . . . , 1 in this order, i.e., in the reverse sequence with respect to the first frame, while picture elements on each scanning line are address-scanned.

Thus, the scanning sequence of the scanning lines 1 through n is reversed between the first frame and the second frame. Therefore, a waiting time of each picture element from the start of the optical response state at which a driving voltage is applied to the switching ON of the backlight is substantially averaged between the first frame and the second frame. For example, as shown in FIG. 1C and 1D, in the first frame, the waiting time of the picture element P1*x* belonging to the scanning line 1 from the addressing scan of the picture element P1*x* to the switching-ON of the backlight is $\tau 1$, while the waiting time of the picture element Pnx belonging to the scanning line n from the addressing scan of the picture element Pnx to the switching-ON of the backlight is Tn. Further, in the second frame, the waiting time of the picture element P1*x* belonging to the scanning line 1 from the addressing scan of the picture element P1*x* to the switching-ON of the backlight is $\tau n$, while the waiting time of the picture element Pnx belonging to the scanning line n from the addressing scan of the picture element Pnx to the switching-ON of the backlight is $\tau 1$. Thus, the waiting times $\tau 1$ and Tn change their positions. When the addressing scan of picture elements is performed from the first frame to the second frame, the waiting time of the picture element P1*x* belonging to the scanning line 1 is $\tau 1+\tau n$, while the waiting time of the picture element Pnx belonging to the scanning line n is $\tau n+\tau 1$. Therefore, the waiting time from the addressing scan to the switching ON of the backlight is the same between the picture element P1*x* belonging to the scanning line 1 and the picture element Pnx belonging to the scanning line n. Thereby, the light modulation states of the picture elements on the scanning lines are substantially averaged. Therefore, the brightness of the picture element P1*x* and the picture element Pnx in the light modulation states at the time of the switching ON of the backlight is substantially averaged by repeating the addressing scan of the picture elements in each display frame.

Alternatively, address scanning of picture elements on the scanning lines may be successively performed from the scanning line 1 to the scanning line n for two successive display frames (e.g., first and second frames). For two subsequent display frames (e.g., third and fourth frames), address scanning may be performed from the scanning line n to the scanning line 1, i.e., in the reverse sequence with respect to the two previous frames. In this case, the light modulation states of the picture elements on the scanning lines can also be substantially averaged as described above.

The addressing scan of picture elements on each scanning line may be performed on a picture element-by-picture element basis. Alternatively, as with most liquid crystal display apparatuses, the addressing scan may be performed on a scanning line-by-scanning line basis.

When a part or the entirety of the addressing scan which applies a driving voltage to each picture element is performed during the ON-state of the backlight, display information contained in two successive display frames across the addressing scan are mixed, which is likely to lead to deterioration of image quality. Therefore, as described above, the addressing scan which applies a driving voltage to each picture element on scanning lines is preferably performed when the backlight is OFF. The switching ON of the backlight is preferably performed after the addressing scan.

The period of scanning a display frame is preferably less than or equal to about 1/60 seconds in order to prevent the switching ON-OFF of the backlight from being recognized as a flicker by a human being.

The compaction ratio of the backlight is preferably about 50% or less, and more preferably about 25% or less in terms of the suppression of blurred images.

Further, the light modulation states of all picture elements on the scanning lines may be reset to a predetermined state before the start of address scanning in order to average the light modulation states of each picture element.

Figure 2A:
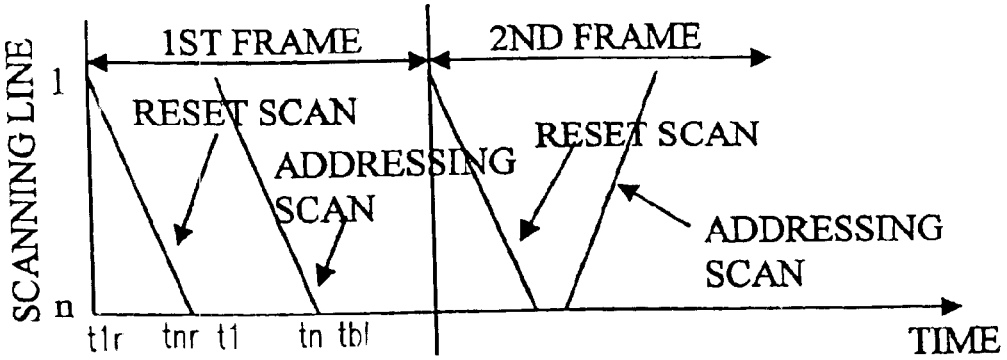
FIG. 2A is a time chart showing another type of address scanning before which the light modulation states of picture elements are reset.
Figure 2B:
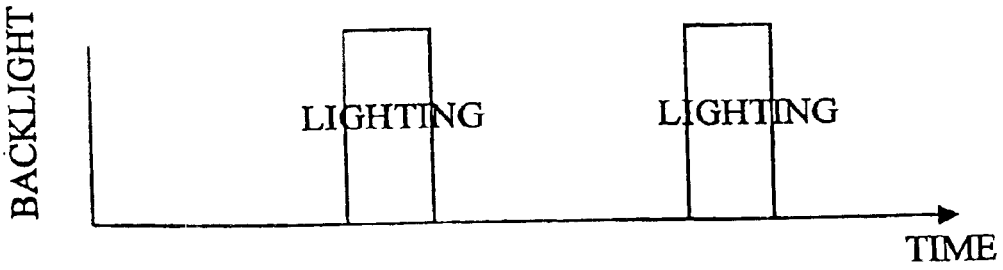
FIG. 2B is a time chart showing switching ON-OFF of a backlight.

FIG. 2A is a time chart showing another type of addressing scan (reset scan). In this reset scan, the light modulation states of all picture elements are reset in the first and second frames before the start of address scanning for applying driving voltages to the picture elements on the scanning lines. In the first and second frames, all picture elements on the scanning lines are successively reset from the first scanning line 1 to the last scanning line n. After the reset scan period (from t1*r* to tnr), in the first frame, address scanning for applying driving voltages to the picture elements on the scanning lines is successively performed from the first scanning line 1 to the last scanning line n. After the addressing scan period (from t1 to tn), as shown in FIG. 2B, the backlight is switched ON. In the second frame, after the reset scan period (from t1*r* to tnr), address scanning for applying driving voltages to the picture elements on the scanning lines is successively performed in the reverse sequence with respect to the scanning sequence of the first frame, i.e., from the scanning line n to the scanning line 1. After the addressing scan period (from t1 to tn), as shown in FIG. 2B, the backlight is switched ON.

Figure 3A:
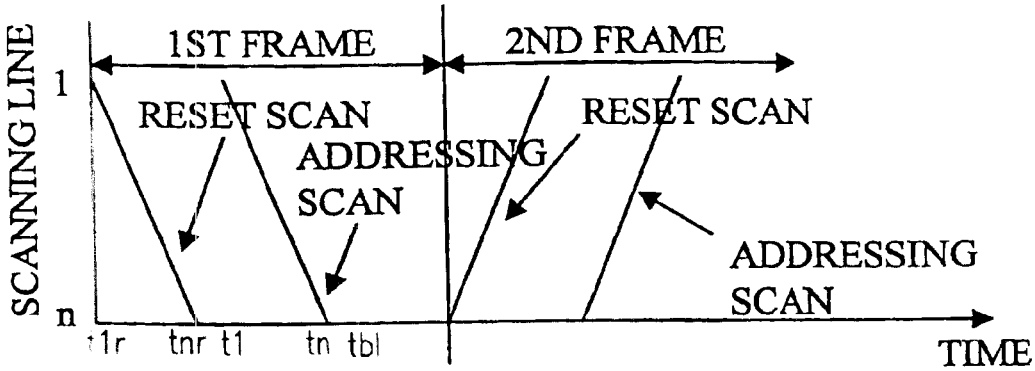
FIG. 3A is a time chart showing still another type of address scanning before which the light modulation states of picture elements are reset.
Figure 3B:
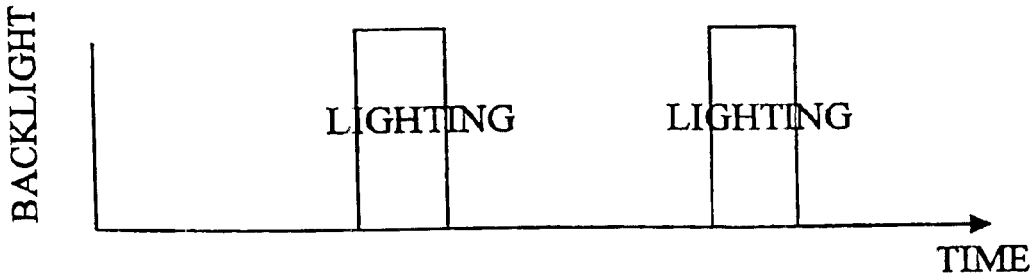
FIG. 3B is a time chart showing switching ON-OFF of a backlight.
Figure 4A:
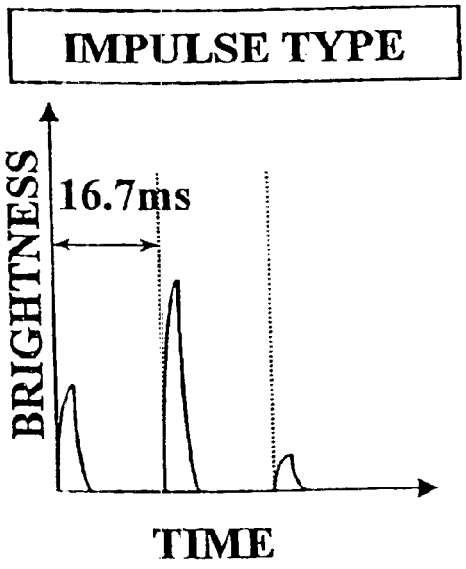
FIG.4A PRIOR ART
FIG. 4A is a graph showing the time response characteristic of the brightness of a CRT with respect to displaying light.
Figure 4B:
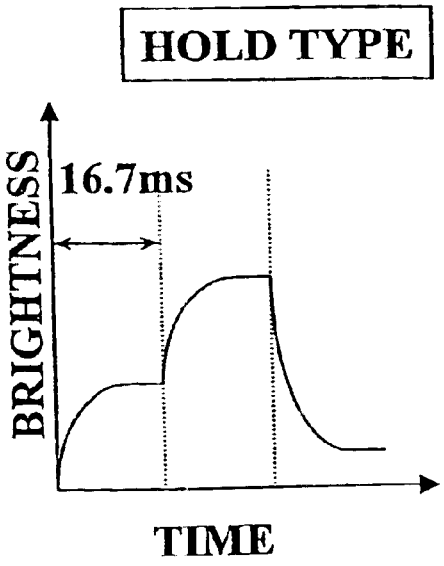
FIG.4B PRIOR ART
FIG. 4B is a graph showing the time response characteristic of the brightness of an LCD with respect to displaying light.
Figures 5A, 5B:
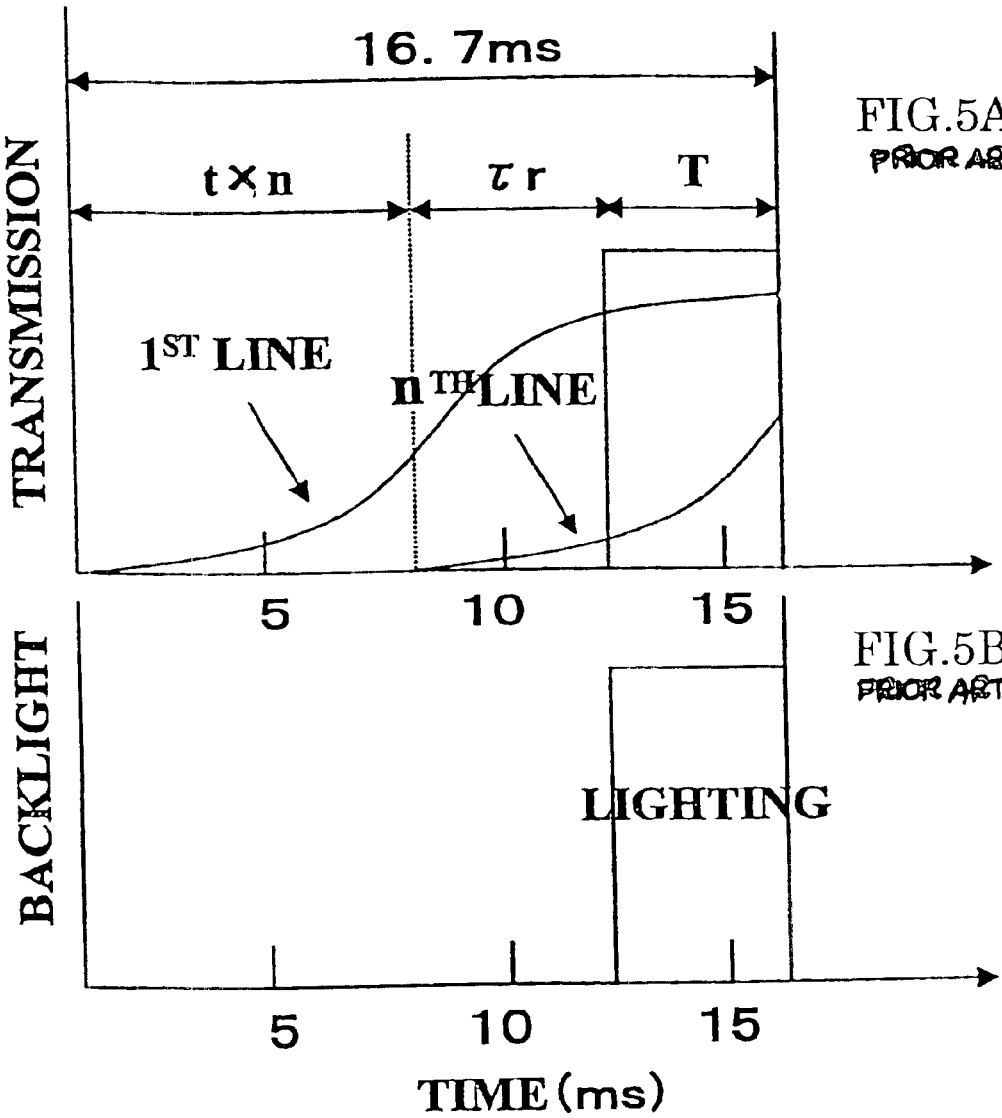
FIG.5A PRIOR ART
FIG.5B PRIOR ART
FIG. 5A is a time chart showing the transmission of liquid crystal.
FIG. 5B is a time chart showing the amount of light from a backlight.
Figures 6A, 6B:
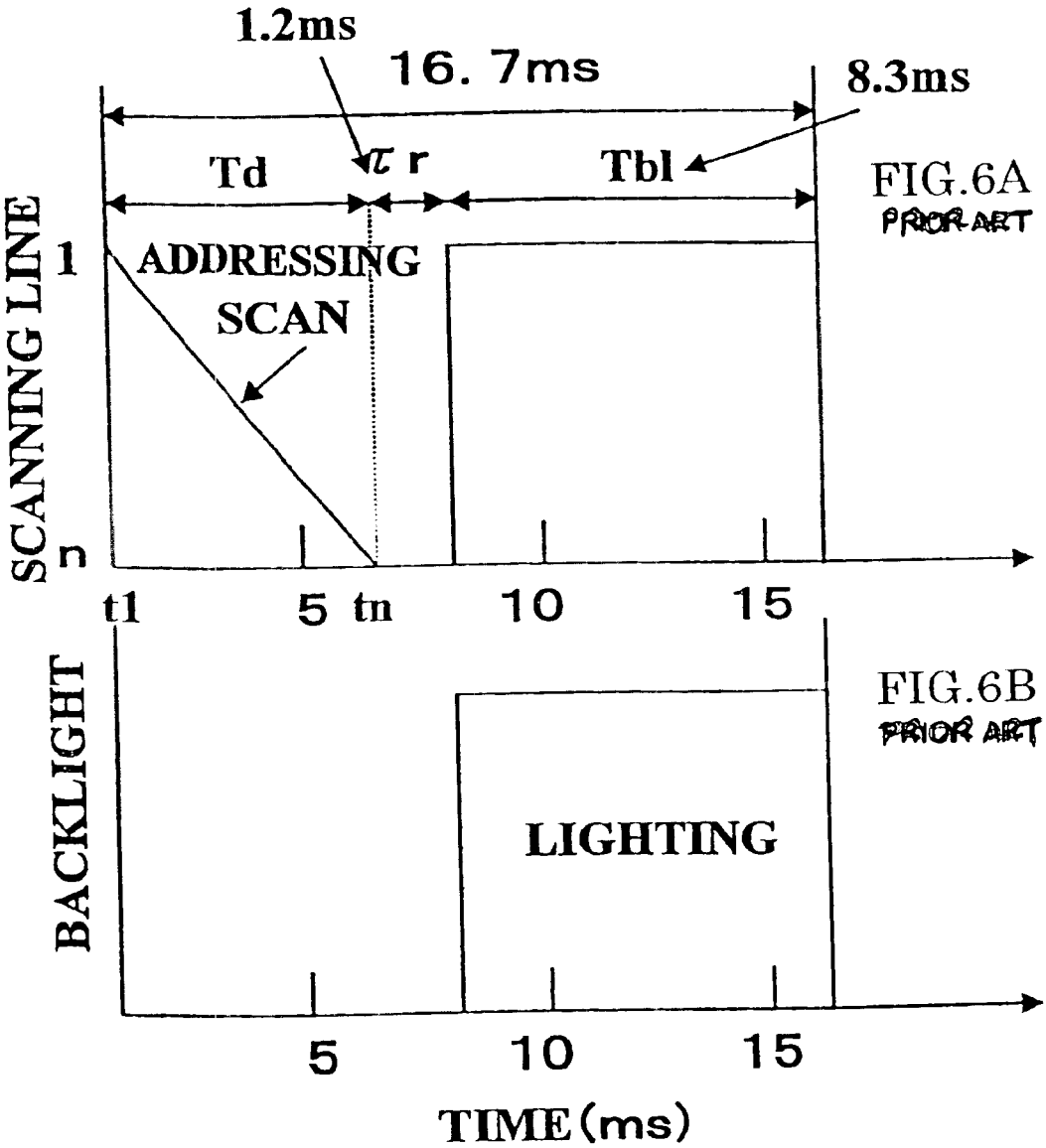
FIG.6A PRIOR ART
FIG.6B PRIOR ART
FIG. 6A is a time chart showing address scanning for picture elements on scanning lines.
FIG. 6B is a time chart showing the emission period of a backlight.

FIG. 3A is a time chart showing still another type of addressing scan (reset scan). In this reset scan, the light modulation states of all picture elements are reset in the first and second frames before the start of address scanning for applying driving voltages to the picture elements on the scanning lines. As is different from the case of FIG. 2A, the addressing scan and the reset scan for the picture elements on the scanning lines are performed in the same sequence of scanning lines, i.e., both the addressing scan and the reset scan are performed in a different sequence of scanning lines between the first and second frames. Specifically, in the first frame, all picture elements on the scanning lines are successively reset from the first scanning line 1 to the last scanning line n. After the reset scan period (from t1*r* to tnr), in the first frame, the addressing scan for applying driving voltages to the picture elements on the scanning lines is successively performed from the first scanning line 1 to the last scanning line n. After the addressing scan period (from t1 to tn), as shown in FIG. 3B, the backlight is switched ON. In the second frame, all picture elements on the scanning lines are successively reset in the reverse sequence with respect to the scanning sequence of the first frame, i.e., from the last scanning line n to the first scanning line 1. After the reset scan period (from t1*r* to tnr), the addressing scan for applying driving voltages to the picture elements on the scanning lines is successively performed from the scanning line n to the scanning line 1. After the addressing scan period (from t1 to tn), as shown in FIG. 3B, the backlight is switched ON.

In the cases of FIGS. 2A, 2B, 3A, and 3B, the light modulation states of all picture elements are reset to an initial state, so that gray levels can be stably achieved when address scanning is performed in such a manner as to average the light modulation states.

The above-described picture element may be any element capable of modulating light, such as a liquid crystal element and a mechanical light shutter. Preferably, an active element (e.g., a thin film transistor and a thin film diode) is attached to a picture element in order to stably display gray levels.

A backlight is necessarily to be a light emitting element which can be arbitrarily switched ON-OFF. Examples of backlights include a cold cathode tube, an electroluminescent element, and a light emitting diode.

Hereinafter, three liquid crystal display apparatuses which were actually produced according to the present invention will be described. The three liquid crystal display apparatuses each included a 10.4-inch diagonal VGA TFT type liquid crystal display panel and a cold cathode tube type backlight.

The first liquid crystal display apparatus included a liquid crystal display panel having a cell thickness of about 4 $\mu$m (the cell thickness is a thickness of a liquid crystal portion). TN liquid crystal was used in the liquid crystal display panel. Considering the gate ON time of a TFT, only 1/4 of the area of the display panel was used to display images. That is, driving voltages were only applied to such an area. The picture elements were driven in a progressive manner.

In the display panel (designated A), address scanning was performed in a driving sequence as shown in FIG. 1A in which the sequence of the scanning lines in the addressing scan is reversed between two successive display frames. The picture elements were driven in a progressive manner and the backlight was switched ON-OFF to display moving images. A time required for the addressing scan of the display area was about 7.2 ms, and the duration of the ON state of the backlight was about 8.3 ms.

Figures 7A, 7B, 7C, 7D:
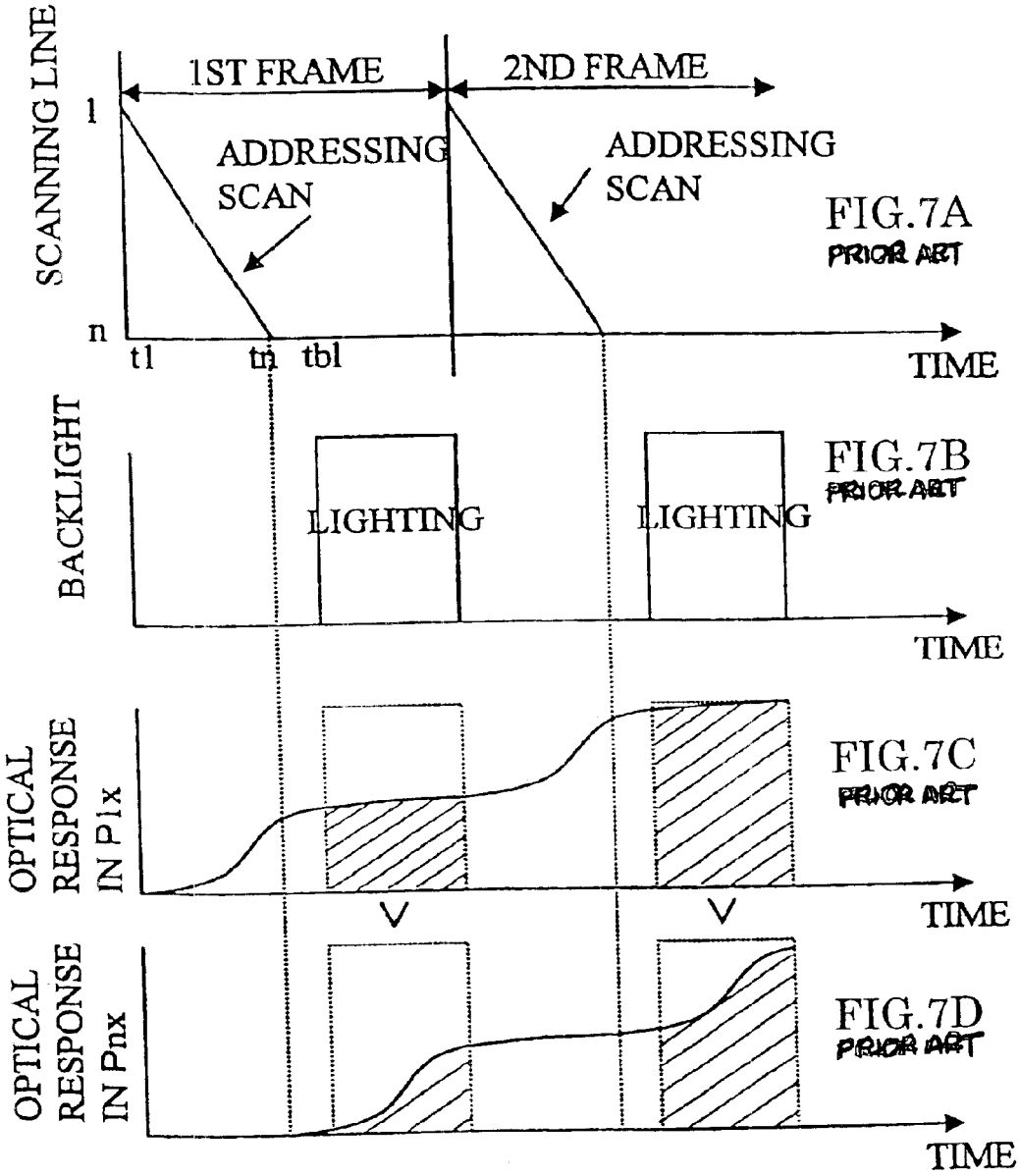
FIG.7A PRIOR ART
FIG.7B PRIOR ART
FIG.7C PRIOR ART
FIG.7D PRIOR ART
FIGS. 7A through 7D are time charts showing a driving sequence of picture elements in a conventional image display apparatus.
Figure 8:
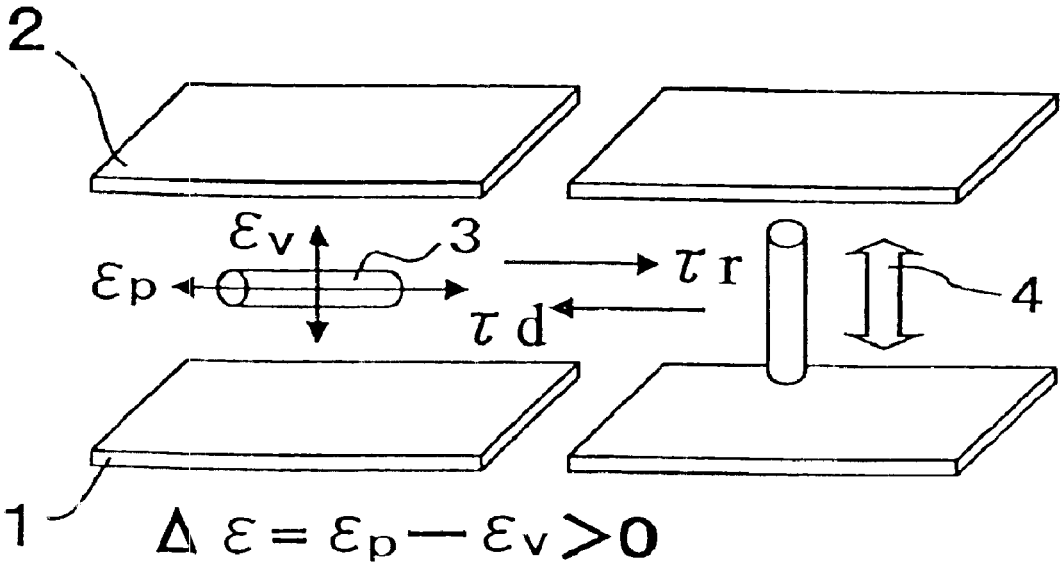
FIG.8 PRIOR ART
FIG. 8 is a diagram showing the field response properties (rise response and fall response) of nematic liquid crystal.
Figure 9:
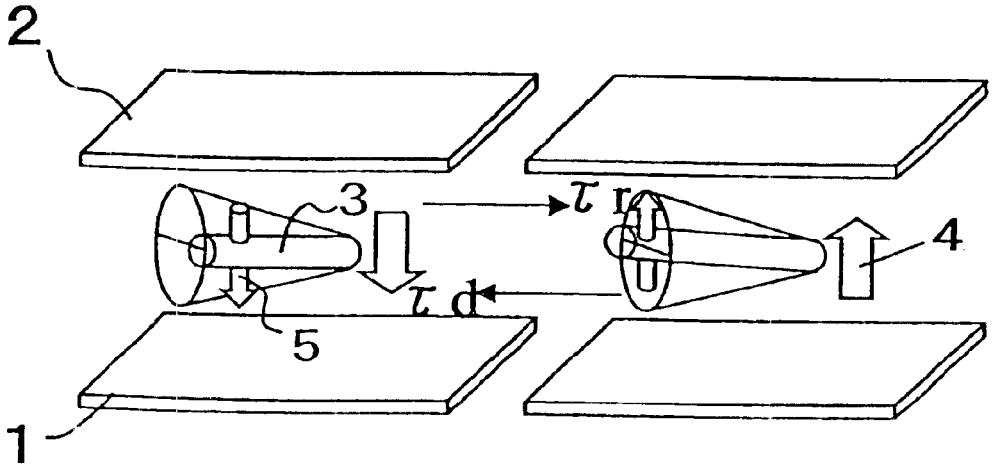
FIG.9 PRIOR ART
FIG. 9 is a diagram showing the field response properties (rise response and fall response) of ferroelectric liquid crystal.
Figure 10A:
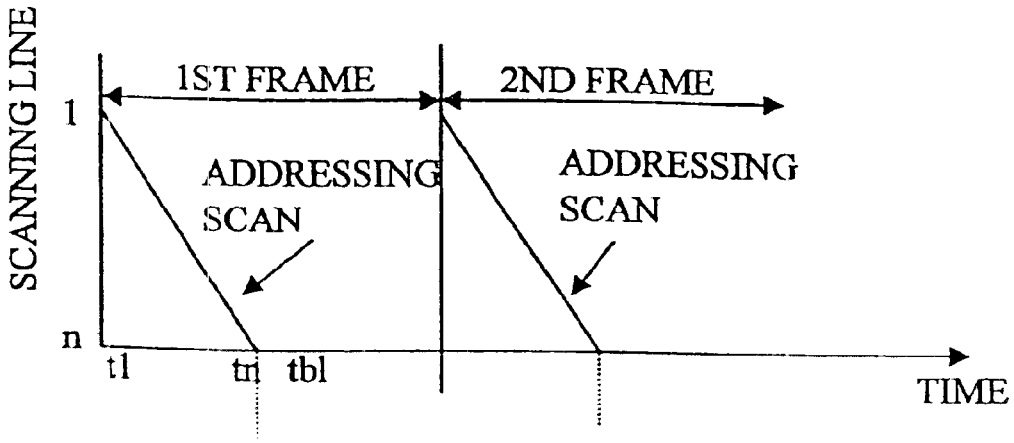
FIG.10A PRIOR ART
FIG. 10A is a time chart showing address scanning for picture elements on scanning lines.
Figure 10B:
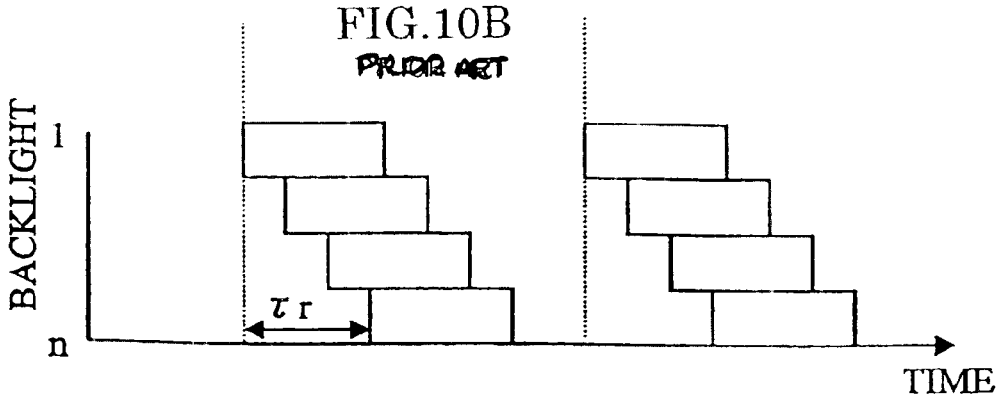
FIG.10B PRIOR ART
FIG. 10B is a time chart showing switching ON-OFF of backlights divided into blocks.

For the purpose of comparison, in a display panel (designated B), address scanning was performed in accordance with a driving sequence as shown in FIG. 7A. The picture elements were driven in a progressive manner and the backlight was switched ON-OFF.

Moving images were displayed by address scanning in the display areas of the display panels A and B. For both the display panels A and B, blurred images were substantially suppressed due to the switching ON-OFF of the backlight. As to the display uniformity of moving images, the display panel A is better compared to the panel B.

The second liquid crystal display apparatus included a liquid crystal display panel having a cell thickness of about 4 $\mu$m. TN liquid crystal was used in the liquid crystal display panel. Considering the gate ON time of a TFT, only 200 scanning lines of the display panel were used to display images. The picture elements were driven in a progressive manner.

In the display panel (designated A), address scanning was performed in a driving sequence as shown in FIG. 2A in which the light modulation states of picture elements are reset (reset scan). The picture elements were driven in a progressive manner and the backlight was switched ON-OFF to display moving images. A time required for each of the addressing scan and the reset scan was about 6 ms, and the duration of the ON state of the backlight was about 4 ms.

For the purpose of comparison, in a display panel (designated B), address scanning was performed in accordance with a driving sequence as shown in FIG. 7A. The picture elements were driven in a progressive manner and the backlight was switched ON-OFF.

Moving images were displayed by the addressing scan in the display areas of the display panels A and B. For both the display panels A and B, blurred images were substantially suppressed due to the switching ON-OFF of the backlight. As to the display uniformity of moving images, the display panel A is better compared to the panel B.

The third liquid crystal display apparatus included a liquid crystal display panel having a cell thickness of about 4 $\mu$m. TN liquid crystal was used in the liquid crystal display panel. Considering the gate ON time of a TFT, only 200 scanning lines of the display panel were used to display images. The picture elements were driven in a progressive manner.

In the display panel (designated A), address scanning was performed in a driving sequence as shown in FIG. 3A in which the sequence of the scanning lines when the light modulation states of picture elements are reset (reset scan) is reversed between two successive display frames. The picture elements were driven in a progressive manner and the backlight was switched ON-OFF to display moving images. A time required for each of the addressing scan and the reset scan was about 6 ms, and the duration of the ON state of the backlight was about 4 ms.

For the purpose of comparison, in a display panel (designated B), address scanning was performed in accordance with a driving sequence as shown in FIG. 7A. The picture elements were driven in a progressive manner and the backlight was switched ON-OFF.

Moving images were displayed by the addressing scan in the display areas of the display panels A and B. For both the display panels A and B, blurred images were substantially suppressed due to the switching ON-OFF of the backlight. As to the display uniformity of moving images, the display panel A is better compared to the panel B.

As described above, in an image display apparatus of the present invention, the backlight is switched ON-OFF once in each display frame, and address scanning is performed for the OFF-state period of the backlight. Further, the sequence of the scanning lines in the addressing scan is reversed every one or more display frames. Therefore, the light modulation states of the picture elements on the scanning lines are averaged, thereby making it possible to reduce display deviation on a display screen.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. An image display apparatus, comprising:

a display section including picture elements for modulating light transmission or reflection;

a driving section for performing an addressing scan of the picture elements in such a manner as to successively change light modulation states of the picture elements in each display frame; and a light emitting section for illuminating the display section, wherein the light emitting section is switched ON-OFF exactly once in each display frame, the addressing scan for the picture elements is performed in the OFF state of the light emitting section in each display frame, and the scanning sequence of a plurality scanning line is reversed every one or more display frames for the addressing scan.

2. An image display apparatus according to claim 1, wherein the sequence of the addressing scan of the picture elements is reversed every display frame.

3. An image display apparatus according to claim 1, wherein the addressing scan of the picture elements is performed on every picture element on a scanning line.

4. An image display apparatus according to claim 1, wherein each display frame includes successive first and second periods, in the first period, the addressing scan for changing the light modulation states of the picture elements is performed and the light emitting section is an OFF state, and in the second period, the addressing scan is not performed and the light emitting section is in an ON state.

5. An image display apparatus according to claim 4, wherein the light modulation states of all of the picture elements are reset during the first period of each display frame.

6. An image display apparatus according to claim 1, wherein a frame period of each display frame is about 1/60 seconds.

7. An image display apparatus according to claim 1, wherein in each display frame, an ON-state period of the light emitting section is less than or equal to about 50% of a frame period.

8. An image display apparatus according to claim 1, wherein the light modulation states of all of the picture elements are reset before the start of the addressing scan of the picture elements in the display section.

9. An image display apparatus according to claim 1, wherein each picture element includes a liquid crystal element.

10. An image display apparatus according to claim 1, wherein the light modulation state of each picture element is controlled by an active element.

11. An image display apparatus according to claim 1, wherein the light emitting section is a cold cathode tube.

12. An image display apparatus according to claim 1, wherein the light emitting section is an electroluminescent element.

13. An image display apparatus according to claim 1, wherein the light emitting section is a light emitting diode.

14. An image display apparatus according to claim 1, wherein the light emitting section is selected from a group comprising a cold cathode tube, an electroluminescent element, and a light emitting diode.

15. An image display apparatus, comprising:

a display section including picture elements for modulating light transmission or reflection;

a driving section for performing an addressing scan of the picture elements in such a manner as to successively change light modulation states of the picture elements in each display frame; and a light emitting section for illuminating the display section, wherein the light emitting section is switched ON-OFF once in each display frame, the addressing scan for the picture elements is performed in the OFF state of the light emitting section in each display frame, and the scanning sequence of a plurality scanning line is reversed every one or more display frames for the addressing scan; and wherein each display frame includes successive first and second periods, in the first period, the addressing scan for changing the light modulation states of the picture elements is performed and the light emitting section is an OFF state, and in the second period, the addressing scan is not performed and the light emitting section is in an ON state; and wherein the light modulation states of all of the picture elements are reset during the first period of each display frame.

16. An image display apparatus according to claim 15, wherein the sequence of the addressing scan of the picture elements is reversed every display frame.

17. An image display apparatus according claim 15, wherein the addressing scan of the picture elements is performed on every picture element on a scanning line.

18. An image display apparatus according claim 15, wherein a frame period of each display frame is about 1/60 seconds.

19. An image display apparatus according to claim 15, wherein in each display frame, an ON-state period of the light emitting section is less than or equal to about 50% of a frame period.

20. An image display apparatus according claim 15, wherein the light modulation states of all of the picture elements are reset before the start of the addressing scan of the picture elements in the display section.

* * * * *